US012790794B2

(12) United States Patent
Villarreal et al.

(10) Patent No.: US 12,790,794 B2
(45) Date of Patent: Nov. 10, 2026

(54) WEAR MEMBER HAVING CURVED WALL SCRATCHING TIP PORTION

(71) Applicant: CATERPILLAR INC., Peoria, IL (US)

(72) Inventors: Josiah Ines Villarreal, Peoria, IL (US); Caroline Marie Brewer, Peoria, IL (US); Eric Thomas Sinn, Tremont, IL (US); Douglas Charles Serrurier, Morton, IL (US)

(73) Assignee: CATERPILLAR INC., Peoria, IL (US)

( * ) Notice: Subject to any disclaimer, the term of this patent is extended or adjusted under 35 U.S.C. 154(b) by 342 days.

(21) Appl. No.: 18/431,292

(22) Filed: Feb. 2, 2024

(65) Prior Publication Data

US 2025/0250782 A1 Aug. 7, 2025

(51) Int. Cl.
*E02F 9/28* (2006.01)

(52) U.S. Cl.
CPC ..... *E02F 9/2858* (2013.01); *E02F 9/2825* (2013.01)

(58) Field of Classification Search
CPC ..... E02F 9/2858; E02F 9/2825
USPC ..... D15/29
See application file for complete search history.

(56) References Cited

U.S. PATENT DOCUMENTS 1,333,394 A * 3/1920 Ekman ..... E02F 9/2858 37/453
1,835,701 A * 12/1931 Edmunds ..... E02F 9/285 76/115
2,727,319 A * 12/1955 Evans ..... E02F 9/2866 172/749
3,748,763 A * 7/1973 Zepf ..... E02F 9/2833 37/452
4,037,337 A * 7/1977 Hemphill ..... E02F 9/2825 37/444
4,965,945 A * 10/1990 Emrich ..... E02F 9/2841 37/456
7,882,649 B2 * 2/2011 Carpenter ..... E02F 9/2875 37/455
9,003,681 B2 * 4/2015 Simmons ..... E02F 9/285 37/453
9,057,177 B2 * 6/2015 Renski ..... E02F 9/2808
D774,108 S 12/2016 Balan et al.
D774,564 S 12/2016 Balan et al.
D774,566 S 12/2016 Balan et al.
(Continued)

FOREIGN PATENT DOCUMENTS

AU 2012318431 4/2014
KR 101759746 7/2017
RU 209115 2/2022

*Primary Examiner* — Jamie L Mcgowan

(57) ABSTRACT

A wear member has a body extending from a front surface to a rear surface disposed generally perpendicular to a longitudinal axis. The body defines a mid-plane that is perpendicular to the rear surface and includes the longitudinal axis. The front surface is disposed on one side of the mid-plane. The wear member has a top outer surface and a bottom outer surface. The top outer surface and the bottom outer surface extend from the rear surface and converge at the front surface. The wear member includes first and second side outer surfaces disposed about the longitudinal axis and that extend from the rear surface to the front surface. The wear member includes a rib protruding from the top outer surface and a scoop extending into the body from the bottom outer surface towards the top outer surface.

20 Claims, 9 Drawing Sheets

(56) References Cited

U.S. PATENT DOCUMENTS

| | | | | |
|---|---|---|---|---|
| D775,242 | S | 12/2016 | Balan et al. | |
| D803,274 | S | 11/2017 | Serrurier et al. | |
| D803,275 | S | 11/2017 | Serrurier et al. | |
| D803,898 | S | 11/2017 | Serrurier et al. | |
| D803,900 | S | 11/2017 | Serrurier et al. | |
| D803,902 | S | 11/2017 | Serrurier et al. | |
| D805,112 | S | 12/2017 | Serrurier et al. | |
| D806,759 | S * | 1/2018 | Serrurier | D15/28 |
| 10,106,960 | B2 * | 10/2018 | Jeske | E02F 9/2858 |
| 10,480,162 | B2 * | 11/2019 | Serrurier | E02F 9/2825 |
| D897,379 | S | 9/2020 | Sinn et al. | |
| 11,788,260 | B2 * | 10/2023 | Serrurier | E02F 9/2833 37/455 |
| 12,123,176 | B2 * | 10/2024 | Serrurier | E02F 9/2858 |
| 2002/0043010 | A1 * | 4/2002 | Ketting | E02F 9/2858 37/452 |
| 2008/0256832 | A1 * | 10/2008 | Esti | E02F 9/2841 37/456 |
| 2012/0186113 | A1 * | 7/2012 | Harder | E02F 9/2858 37/455 |
| 2012/0246982 | A1 | 10/2012 | Bentley | |
| 2023/0062218 | A1 * | 3/2023 | Serrurier | E02F 9/2833 |

* cited by examiner

WEAR MEMBER HAVING CURVED WALL SCRATCHING TIP PORTION

TECHNICAL FIELD

The present disclosure relates generally to a wear member for a ground engaging implement and, more particularly, to a wear member having a curved wall scratching tip portion.

BACKGROUND

Earth-working and excavating machines, such as wheel loaders, cable shovels, drag lines, electric rope shovels (ERS), excavators, and front shovels, include implements generally used for digging into, ripping, or otherwise moving earth, rocks, debris, or other earthen materials. Such implements commonly include various types of buckets having shapes and dimensions dependent on the type of bucket and size of the machine employing a particular bucket. These implements are subjected to abrasion and impacts that cause them to wear. To prolong the useful life of these implements, various shrouds, or wear members, can be connected to the earth-working and excavating implements in areas which experience wear, for example, at a lip of a bucket. The wear members may be connected to the implements using a retention system that permits replacement of the wear members when they become worn to the extent that require replacement.

In some earth-working operations, for example, excavation operations, the wear members may repeatedly engage with the earth, rocks, debris, or other earthen materials, and are, therefore, subjected to a significant amount of wear. For such operations, the wear members may be provided with a narrower front end to allow the wear members to penetrate deeper into the earthen materials. However, narrowing the front end may result in a relatively weaker wear member that may experience higher amount of wear and/or breakage. Strengthening the wear members by adding material to the narrower front end may reduce their effectiveness in penetrating the earthen materials. Furthermore, adding too much material to the wear members may make the wear members heavier and more expensive. A heavier wear member may also be more difficult to manipulate during repair, replacement, or assembly of the wear members to the implements at a work site.

The wear member and tip assembly of the present disclosure solve one or more of the problems set forth above and/or other problems of the prior art.

SUMMARY

In one aspect, the present disclosure is directed to a wear member. The wear member may include a body extending from a front surface to a rear surface disposed generally perpendicular to a longitudinal axis. The body may define a mid-plane for the rear surface. The mid-plane may be perpendicular to the rear surface and include the longitudinal axis. The front surface may be disposed on one side of the mid-plane. The wear member may include a top outer surface and a bottom outer surface. The top outer surface and the bottom outer surface may extend from the rear surface and converge at the front surface. The wear member may include first and second side outer surfaces disposed about the longitudinal axis. The first and second side outer surfaces may extend from the rear surface to the front surface and between the top outer surface and the bottom outer surface. The wear member may include a rib protruding from the top outer surface. The wear member may also include a scoop extending into the body from the bottom outer surface towards the top outer surface.

In another aspect, the present disclosure is directed to a wear member. The wear member may include a body extending from a front surface to a rear surface disposed generally perpendicular to a longitudinal axis. The body may define a mid-plane for the rear surface. The mid-plane may be perpendicular to the rear surface and include the longitudinal axis. The front surface may be disposed above the mid-plane. The wear member may include a top outer surface and a bottom outer surface. The top outer surface and the bottom outer surface may extend from the rear surface and converge at the front surface. The bottom outer surface may include a rear bottom surface extending from the rear surface towards the front surface. The bottom outer surface may also include a front bottom surface extending from the front surface toward the rear surface. The front bottom surface may be inclined at a first angle relative to the mid-plane. Further, the bottom outer surface may include an intermediate bottom surface extending from the rear bottom surface to the front bottom surface. The intermediate bottom surface may be inclined at a second angle smaller than the first angle relative to the mid-plane. The wear member may include first and second side outer surfaces converging from the rear surface towards the front surface. The wear member may include a rib protruding from the top outer surface. The wear member may also include a scoop extending into the body from the bottom outer surface towards the top outer surface.

In yet another aspect, the present disclosure is directed to a tip assembly. The tip assembly may include an adapter and a wear member configured to be connected to the adapter. The adapter may include a nose and top and bottom legs protruding from the nose. The top and bottom legs may define a gap configured to receive a lip portion of a ground engaging implement. The wear member may include a body extending in a lengthwise direction of the tip assembly from a front surface to a rear surface disposed generally perpendicular to a longitudinal axis. The body may define a mid-plane for the rear surface. The mid-plane may be perpendicular to the rear surface and include the longitudinal axis. The front surface may be disposed above the mid-plane. The wear member may include a nose cavity extending into body from the rear surface towards the front surface. The nose cavity may be configured to receive the nose of the adapter. The wear member may include a top outer surface and a bottom outer surface. The top outer surface and the bottom outer surface may extend from the rear surface and converge at the front surface. The bottom outer surface may include a rear bottom surface extending from the rear surface towards the front surface. The bottom outer surface may also include a front bottom surface extending from the front surface toward the rear surface. The front bottom surface may be inclined at a first angle relative to the mid-plane. The bottom outer surface may also include an intermediate bottom surface extending from the rear bottom surface to the front bottom surface. The intermediate bottom surface may be inclined at a second angle smaller than the first angle relative to the mid-plane. The wear member may include first and second side outer surfaces disposed about the longitudinal axis. The first and second side outer surfaces may converge from the rear surface towards the front surface. The wear member may include a rib protruding from the top outer surface. The wear member may also include a scoop extending into the body from the intermediate inclined bottom surface towards the top outer surface.

DETAILED DESCRIPTION

Figure 1:
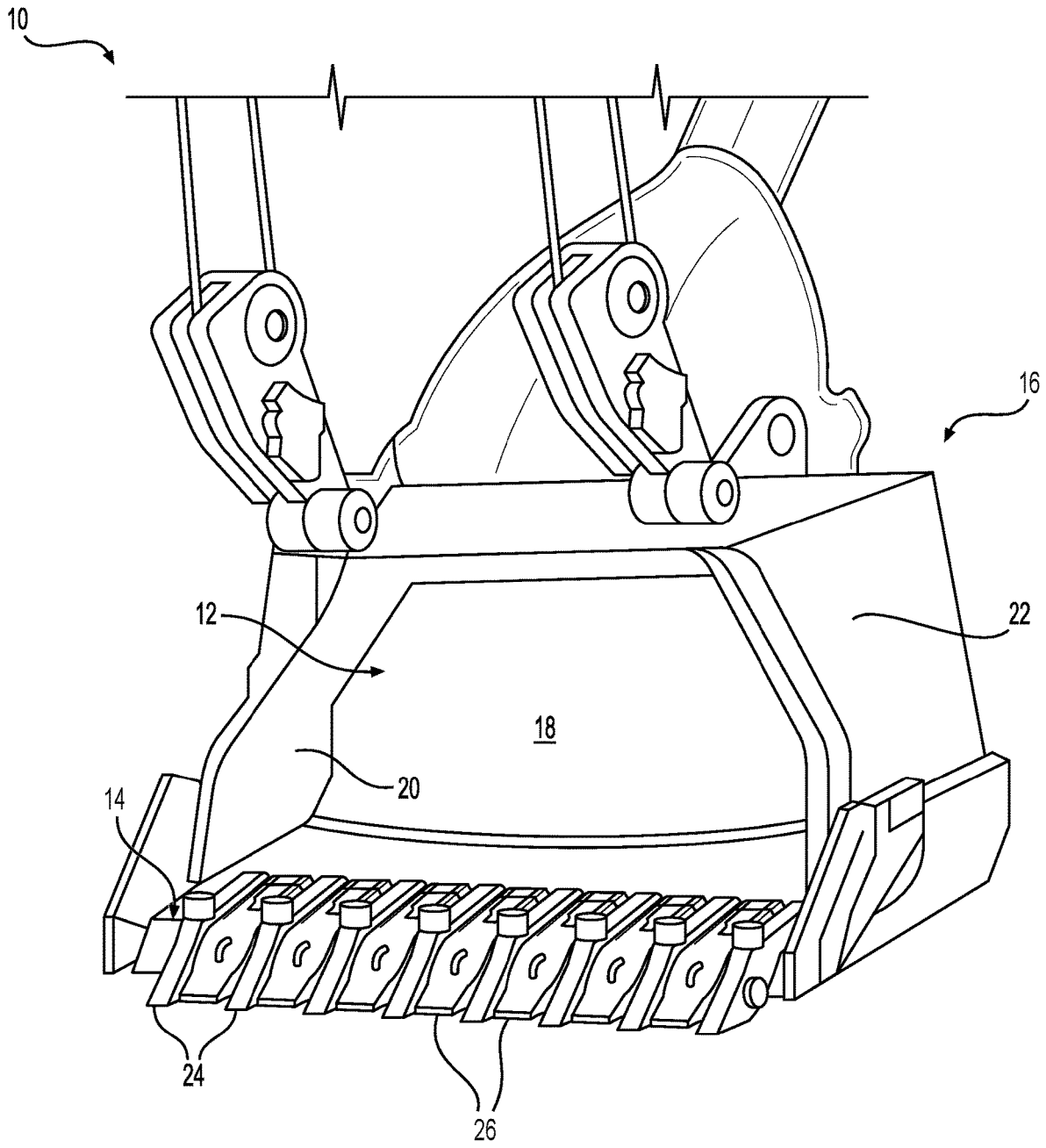
FIG. 1 is an illustration of an exemplary ground engaging implement.

FIG. 1 illustrates an exemplary ground engaging implement 10 for a machine (not shown). As illustrated in FIG. 1, ground engaging implement 10 may be in the form of bucket 12. While ground engaging implement 10 is illustrated in FIG. 1 and described as a bucket 12, the disclosed embodiments of a wear member may be employed in connection with ground engaging implements other than a bucket. For example, wear members according to disclosed embodiments may be employed on a separate ground engaging edge or lip member that is attached to a bucket, scoop, or other excavating or material handling implement. Bucket 12 may be of the type employed in various machines such as, for example, an electric rope shovel (shown in FIG. 1), a dragline, a hydraulic excavator, a backhoe, a tracked or wheeled loader, etc., and may be shaped somewhat differently depending on the type of machine in which it is employed. Some buckets or other ground engaging implements may include one or more apertures that receive various fasteners or retaining members intended to secure replaceable wear members of various types thereto. Such existing apertures may conveniently be used in connection with disclosed embodiments of a wear member retention system.

Bucket 12 may include lip portion 14, sometimes referred to as a digging edge, cutting edge, base edge, or edge member, and one or more wall members defining a container portion 16 for material. For example, container portion 16 of bucket 12 includes a primary wall member 18 which may serve as a bottom and back wall, and two side wall members 20 and 22. Other bucket forms are contemplated, depending on the type of machine on which the bucket may be employed. Lip portion 14 may be provided with a plurality of tooth assemblies 24, and with a plurality of wear members 26. For example, wear member 26 may be provided between each pair of adjacent tooth assemblies 24. Lip portion 14 may be detachable from bucket 12, e.g., secured by bolts or other fasteners, or it may be a fixed component of bucket 12, e.g., welded to primary wall member 18.

Figure 2:
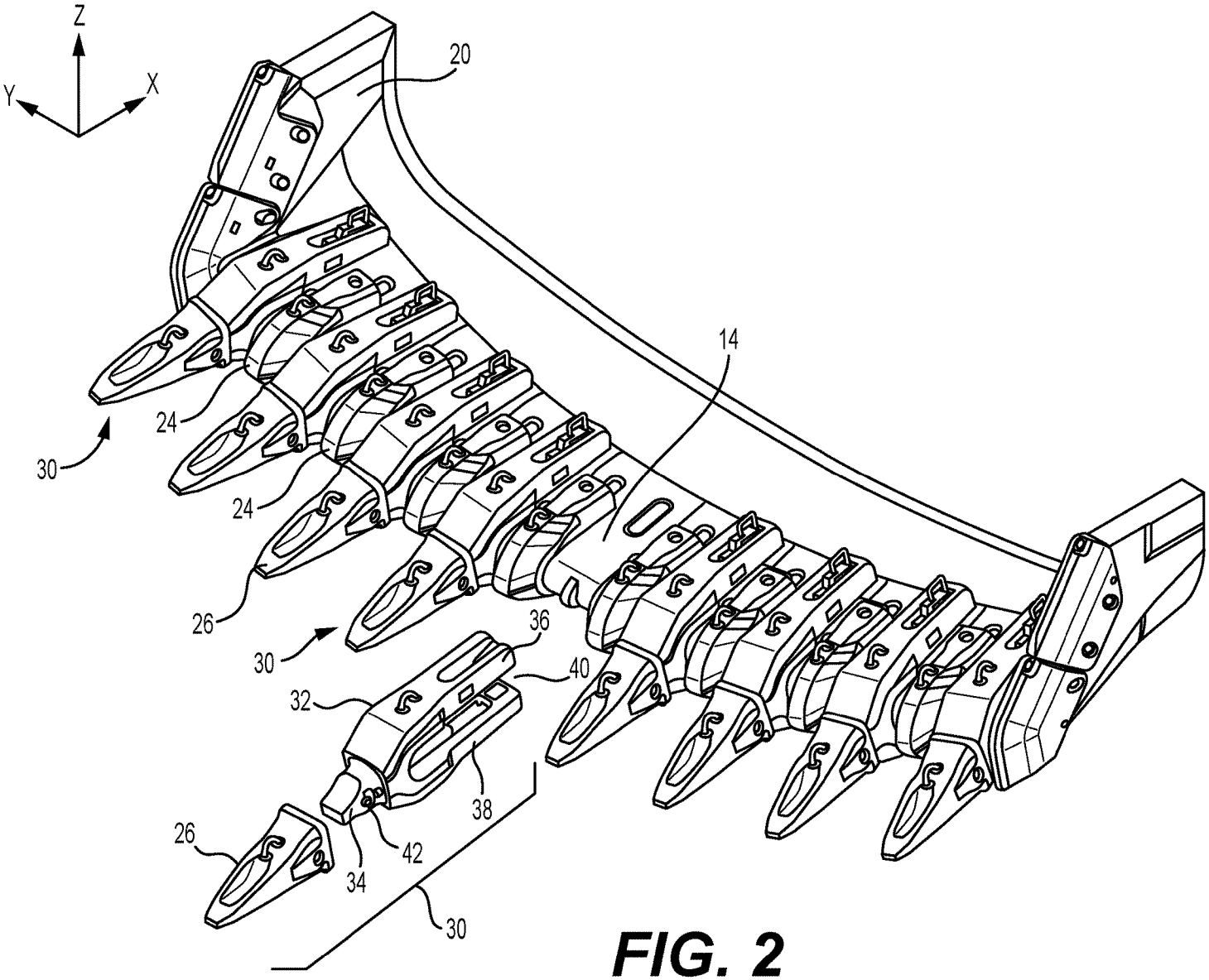
FIG. 2 is a magnified view of a lip of the exemplary ground engaging implement of FIG. 1, illustrating exemplary shrouds, adapters, and wear members.

FIG. 2 is a magnified view of lip portion 14 of bucket 12, illustrating tooth assemblies 24 and one or more tip assemblies 30. Tooth assemblies 24 may be attached to lip portion 14 between tip assemblies 30 to reduce wear and abrasion of lip portion 14 of bucket 12 when bucket 12 engages with working materials. As also illustrated in FIG. 2, tip assembly 30 may include wear member 26 and adapter 32. Adapter 32 may include nose 34, upper leg 36, lower leg 38, and lug 42. Upper leg 36 and lower leg 38 may protrude rearwardly (e.g., in the +X direction) from nose 34. Upper leg 36 and lower leg 38 may be separated by gap 40. Lip portion 14 of ground engaging implement 10 (e.g., bucket 12) may be configured to be received in gap 40 of adapter 32. Upper leg 36 and lower leg 38 of adapter 32 may be attached to lip portion 14, using fasteners, rivets, clamps, adhesives, via welding or brazing, or any other method of attachment. Wear member 26 in turn may be attached to adapter 32, using a retention mechanism (not shown). As will be described elsewhere in this disclosure, wear member 26 may include a nose cavity configured to receive nose 34 of adapter 32. As also illustrated in FIG. 2 nose 34 may include lug 42 that projects outwards from nose 34. As will be described elsewhere in this disclosure, lug 42 may be configured to be received in a channel within the nose cavity. The terms upper and lower or top and bottom as used in this disclosure should be understood as defining positions relative to each other and not necessarily relative to a direction of gravity. Similarly the terms front and rear, left and right, forwardly and rearwardly as used in this disclosure should be understood as defining relative positions. Coordinate axes X, Y, and Z have been illustrated in some of the figures for ease of discussion, however the disclosed embodiments should not be limited to configurations oriented along the disclosed coordinate axes.

Figure 3:
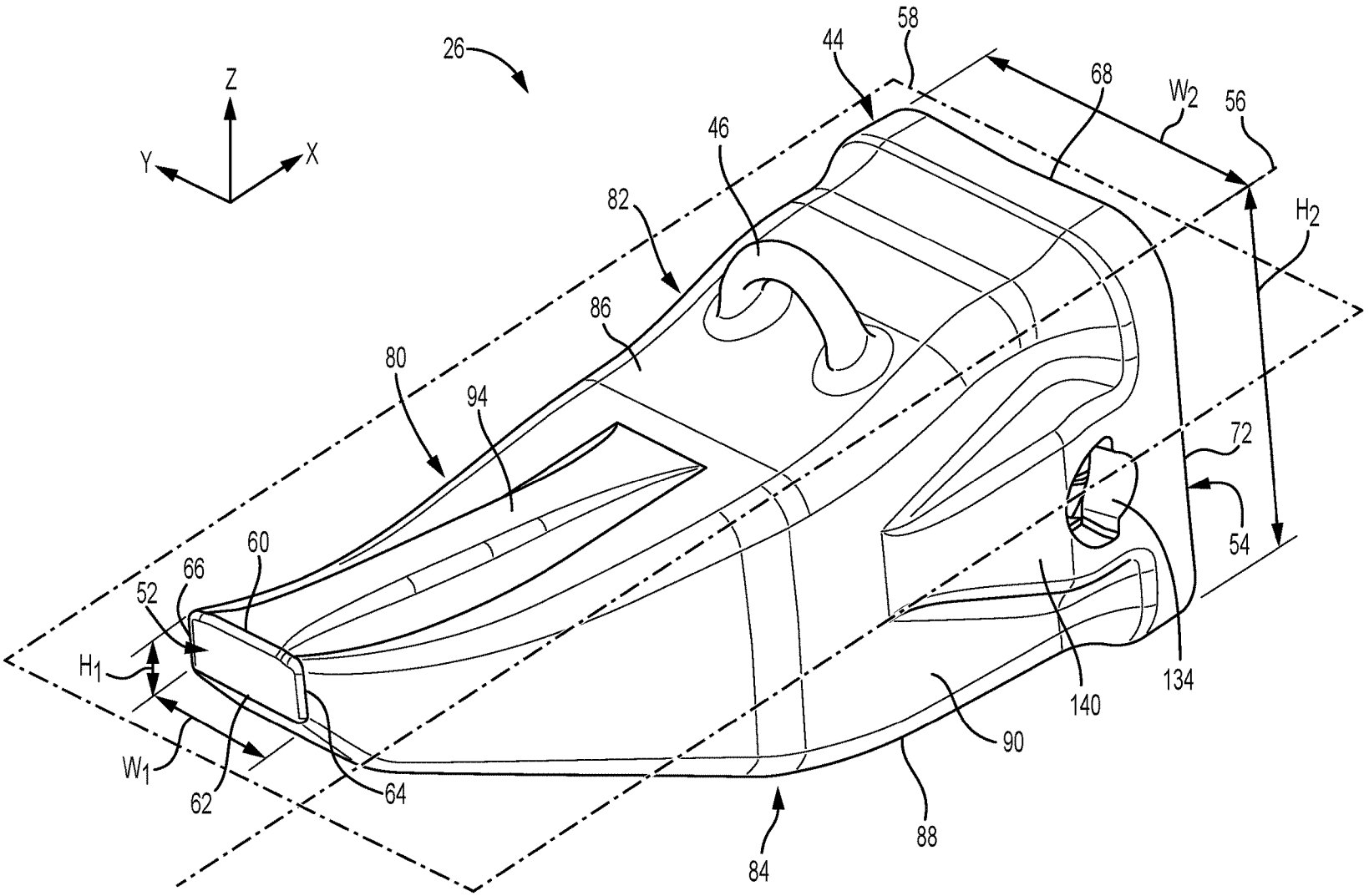
FIG. 3 is a perspective front, top, right side view illustration of an exemplary wear member of FIG. 2.
Figure 4:
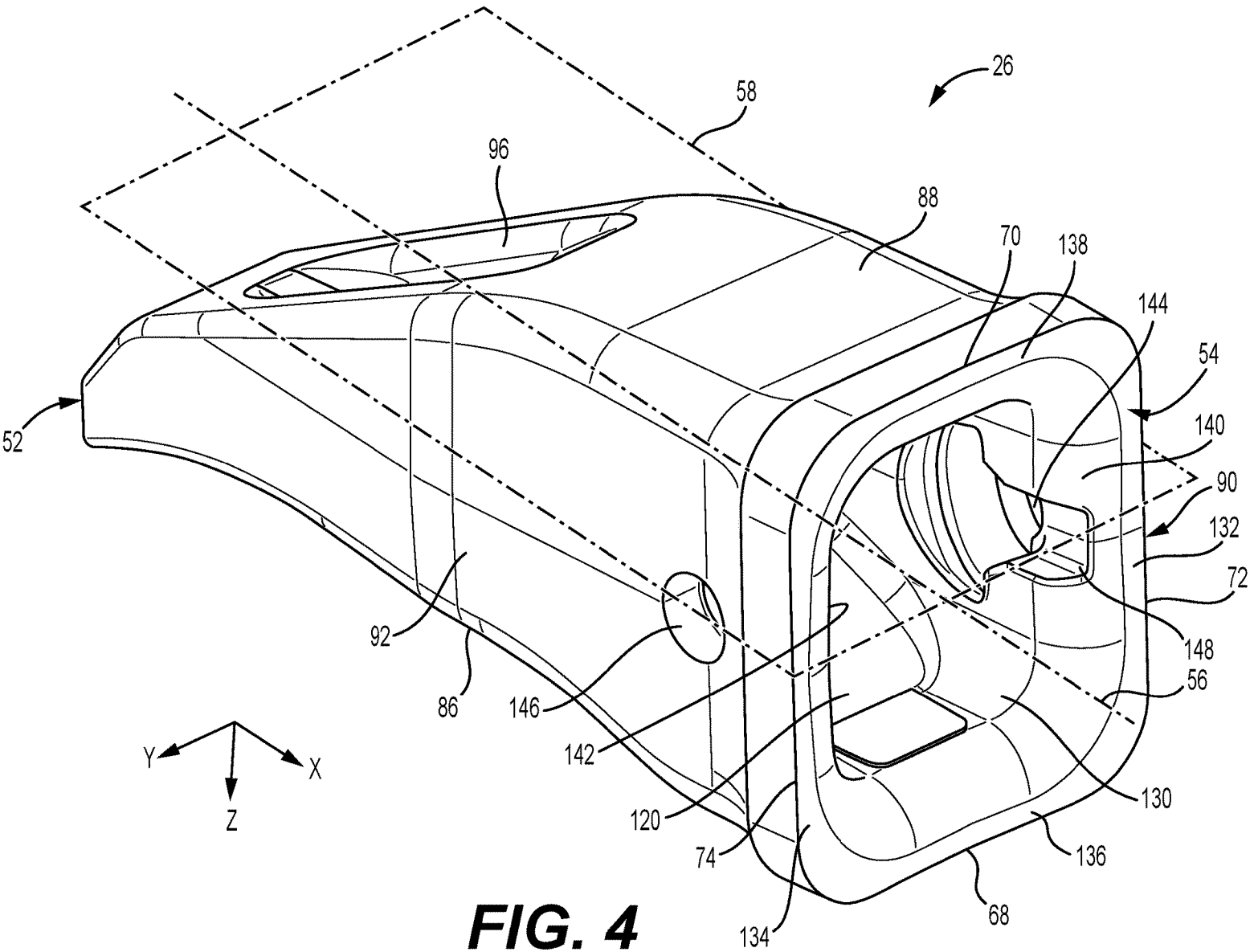
FIG. 4 is a perspective rear, bottom, left side view illustration the wear member of FIG. 3.

FIG. 3 illustrates a perspective front, top, right side view of wear member 26, and FIG. 4 illustrates a perspective rear, bottom, left side view of wear member 26. As illustrated in FIG. 3, wear member 26 may include body 44 and handle 46 used to lift and/or transport wear member 26. Body 44 may extend from front surface 52 to rear surface 54 in a lengthwise direction (e.g., in the +X direction) along longitudinal axis 56 of body 44. Longitudinal axis 56 may be disposed generally perpendicular to rear surface 54 and may extend through a center point of rear surface 54. Front surface 52 may define upper edge 60 and lower edge 62 disposed generally parallel to and vertically spaced apart (e.g., in the Z direction) from upper edge 60. Front surface 52 may also define side edges 64 and 66, each of which is connected at opposite ends to upper edge 60 and lower edge 62. Side edges 64 and 66 may be disposed generally parallel to each other and horizontally spaced apart (e.g., in the Y direction) from each other. Although a generally rectangular shape has been illustrated for front surface 52, front surface 52 may have other shapes, for example, square, circle, triangular, polygonal, or any other desired shape. Rear surface 54 may define upper edge 68 and lower edge 70 (see FIG. 4) disposed generally parallel to and spaced apart from upper edge 68. Rear surface 54 may also define side edges 72 and 74 (see FIG. 4), each of which is connected at opposite ends to upper edge 68 and lower edge 70. Although a generally square shape has been illustrated for rear surface 54 (see, e.g., FIG. 4), rear surface 54 may have other shapes, for example, rectangular, circle, triangular, polygonal, or any other desired shape. Front surface 52 may be narrower than rear surface 54. For example, as illustrated in FIG. 3, a width "$W_1$" of front surface 52 is smaller than a width "$W_2$" of rear surface 54, and a height "$H_1$" of front surface 52 is smaller than a height "$H_2$" of rear surface 54.

As illustrated in FIG. 3, body 44 may define a horizontal mid-plane 58 that may be perpendicular to rear surface 54 and generally parallel to upper edge 68 and lower edge 70 (see, e.g., FIG. 4) of rear surface 54. Mid-plane 58 may include longitudinal axis 56. In one exemplary embodiment as illustrated in FIG. 3, mid-plane 58 is generally perpendicular to the Z axis. Front surface 52 may be disposed on one side of mid-plane 58. For example, as illustrated in FIG. 3, front surface 52 may be disposed above mid-plane 58 (e.g., in the +Z direction). In some exemplary embodiments, front surface 52 may be asymmetrically disposed about mid-plane 58 such that upper edge 60 of front surface 52 may be above mid-plane 58 (e.g., in the +Z direction) whereas lower edge 62 of front surface may be below mid-plane 58 (e.g., in the −Z direction).

As further illustrated in FIG. 3, body 44 may include tip portion 80 and attachment portion 82. Tip portion 80 may extend from front surface 52 towards rear surface 54 and to tip end 84 along longitudinal axis 56. Attachment portion 82 may extend from tip end 84 to rear surface 54 along longitudinal axis 56. Body 44 may also include top outer surface 86, bottom outer surface 88, side outer surface 90 and side outer surface 92 (see FIG. 4). Top outer surface 86 and bottom outer surface 88 may both extend from rear surface 54 to front surface 52. Top outer surface 86 and bottom outer surface 88 may converge from rear surface 54 towards the front surface 52. Top outer surface 86 may be connected to front surface 52 along upper edge 60 and may be connected to rear surface 54 along upper edge 68. Bottom outer surface 88 may be connected to front surface 52 along lower edge 62 and may be connected to rear surface 54 along lower edge 70. As further illustrated in FIG. 3, rib 94 may protrude vertically upward (e.g., in the +Z direction) from top outer surface 86. As also illustrated in FIG. 4, scoop 96 may be disposed on bottom outer surface 88 and is in the form of a recess, groove, or depression extending into body 44 from bottom outer surface 88 towards top outer surface 86.

As illustrated in FIGS. 3 and 4, body 44 may include side outer surfaces 90 and 92 (see FIG. 4) both of which may extend from rear surface 54 to front surface 52 and may converge from rear surface 54 towards the front surface 52. Side outer surfaces 90 and 92 may also extend between and be connected to top outer surface 86 and bottom outer surface 88.

Figure 5:
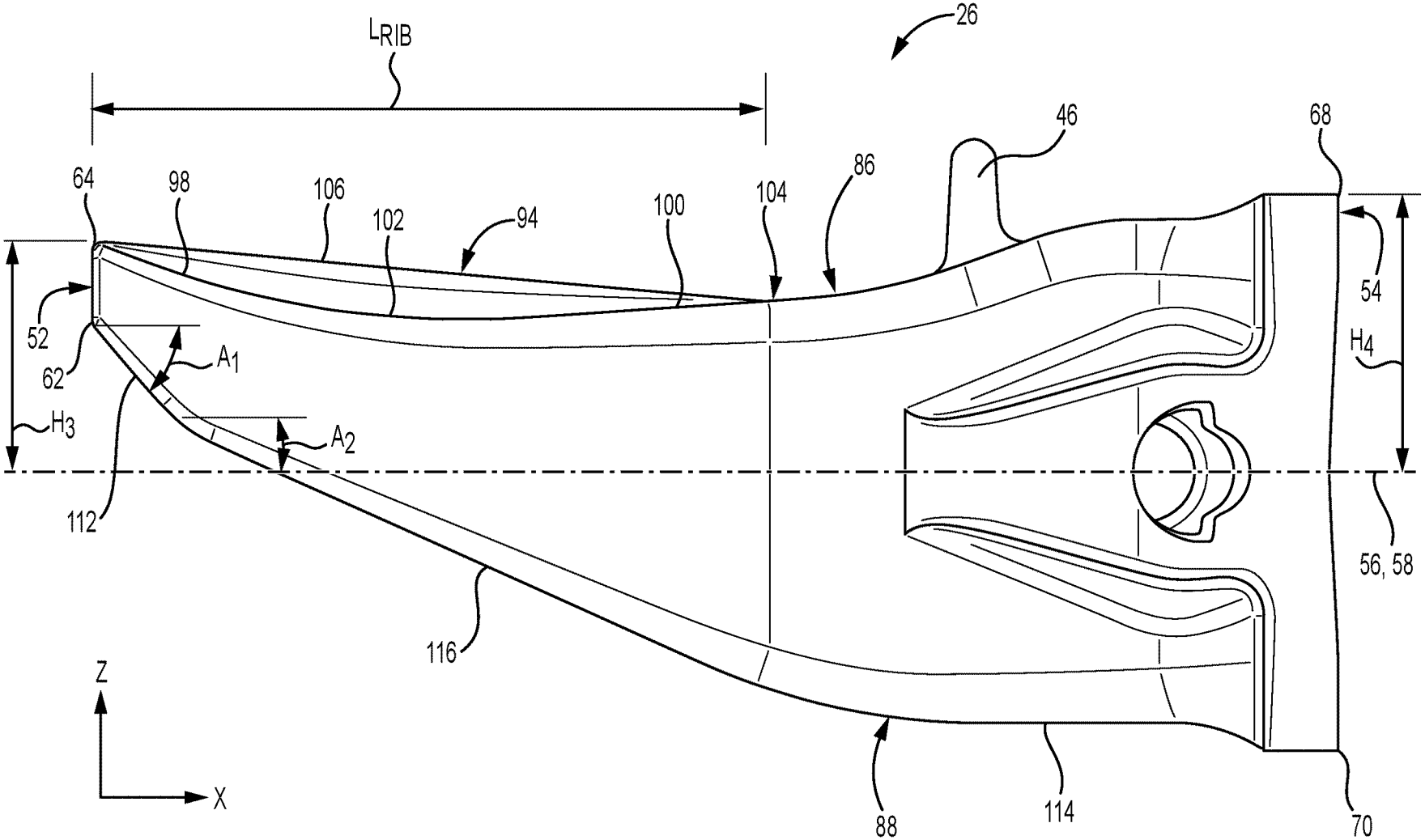
FIG. 5 is a side elevation view of the wear member of FIG. 3.

FIG. 5 illustrates a side elevation view of wear member 26. As illustrated in FIG. 5, front surface 52 is disposed above mid-plane 58 whereas rear surface 54 is disposed symmetrically about mid-plane 58. Thus, both upper edge 60 and lower edge 62 of front surface 52 may be positioned above or on one side (e.g., in the +Z direction) of mid-plane 58, whereas upper edge 68 and lower edge 70 of rear surface 54 may be disposed on opposite sides (e.g., above and below, respectively) of mid-plane 58. As further illustrated in FIG. 5, upper edge 60 of front surface 52 may be positioned at a height "$H_3$" above or relative to mid-plane 58 and upper edge 68 of rear surface 54 may be positioned at height "$H_4$" above or relative to mid-plane 58. In one exemplary embodiment as illustrated in FIG. 5, height $H_3$ is smaller than height $H_4$. However, in some exemplary embodiments, height $H_3$ may be equal to or greater than height $H_4$ such that upper edge 60 of front surface 52 may be disposed at a same height as or higher than upper edge 68 of rear surface 54, relative to mid-plane 58.

As illustrated in FIG. 5, top outer surface 86 may include front top surface 98, rear top surface 100, and intermediate top surface 102. Front top surface 98 may extend from front surface 52 towards rear surface 54. Front top surface 98 may be inclined in a downward direction (e.g., in the −Z direction) towards mid-plane 58. Front top surface 98 may be generally planar or may have a curvilinear surface (e.g., concave surface as viewed in the top-down or −Z direction). Rear top surface 100 may extend from rear surface 54 towards front surface 52. Portions of rear top surface 100 may be generally inclined in a downward direction (e.g., in the −Z direction) towards mid-plane 58 relative to upper edge 68 of rear surface 54. In one exemplary embodiment as illustrated in FIG. 5, rear top surface 100 has a curvilinear shape. In other exemplary embodiments, rear top surface 100 is generally planar. Intermediate top surface 102 may extend between and connect front top surface 98 and rear top surface 100. In one exemplary embodiment as illustrated in FIG. 5, intermediate top surface 102 has a generally concave shape (as viewed in a top-down or −Z direction). However, intermediate top surface 102 may be planar or may have any other shape.

As further illustrated in FIG. 5, wear member 26 may include rib 94 that protrudes upwards (e.g., in the +Z direction) from top outer surface 86. For example, rib 94 may extend from front surface 52 to rib rear end 104 in a direction from front surface 52 to rear surface 54. Rib 94 may have rib outer surface 106 that may be inclined relative to longitudinal axis 56. For example, as illustrated in FIG. 5, rib outer surface 106 may be inclined downwards towards longitudinal axis 56 and mid-plane 58 as rib outer surface 106 extends from front surface 52 towards rear surface 54. However, in some exemplary embodiments, rib outer surface 106 may be disposed generally parallel to longitudinal axis 56 and mid-plane 58, or may be inclined upwards relative to longitudinal axis 56 and mid-plane 58 as rib outer surface 106 extends from front surface 52 towards rear surface 54. Rib 94 may have length "$L_{RIB}$" (or rib length) between front surface 52 and rib rear end 104 along longitudinal axis 56. In some exemplary embodiments, a ratio of a length of wear member 26 (e.g., from front surface 52 to rear surface 54 along longitudinal axis 56) to length $L_{RIB}$ may range between about 1.5 to 6.0. In some exemplary embodiments, a ratio of rib length $L_{RIB}$ to a maximum width of rib 94 (e.g., rib width) may range between about 4 and 20.

Bottom outer surface 88 may include front bottom surface 112, rear bottom surface 114, and intermediate bottom surface 116. Front bottom surface 112 may extend from front surface 52 towards rear surface 54. Front bottom surface 112 may be inclined in a downward direction (e.g., in the −Z direction). In one exemplary embodiment as illustrated in FIG. 5, front bottom surface 112 is located above mid-plane 58. In some exemplary embodiments, front bottom surface 112 may intersect with mid-plane 58 such that a portion of front bottom surface 112 may be located above mid-plane 58 whereas a remaining portion may be located below mid-plane 58. Front bottom surface 112 may have a planar shape, a curvilinear shape, or any other shape.

Rear bottom surface 114 may extend from rear surface 54 towards front surface 52. In one exemplary embodiment as illustrated in FIG. 5, rear bottom surface 114 is generally parallel to mid-plane 58. However, rear bottom surface 114 may be generally inclined toward or away from mid-plane 58. Rear bottom surface 114 may be generally planar or may have a curvilinear surface. Intermediate bottom surface 116 may extend between and connect front bottom surface 112 and rear bottom surface 114. Intermediate bottom surface 116 may be inclined in a downward direction (e.g., in the −Z direction). In one exemplary embodiment as illustrated in FIG. 5, intermediate bottom surface 116 is generally planar. However, intermediate bottom surface 116 may have a curvilinear shape or any other shape. In one exemplary embodiment as illustrated in FIG. 5, intermediate bottom surface 116 is located below mid-plane 58. In some exemplary embodiments, intermediate bottom surface 116 may intersect with mid-plane 58 such that a portion of intermediate bottom surface 116 may be located above mid-plane 58 whereas a remaining portion may be located below mid-plane 58.

In one exemplary embodiment as illustrated in FIG. 5, front bottom surface 112 is inclined at an angle "$A_1$" relative to longitudinal axis 56 and mid-plane 58, and intermediate bottom surface 116 is inclined at an angle "$A_2$" relative to longitudinal axis 56 and mid-plane 58. As also illustrated in the exemplary embodiment of FIG. 5, angle $A_2$ is smaller than angle $A_1$. In other exemplary embodiments, angle $A_2$ may be larger than or about equal to angle $A_1$.

Figure 6:
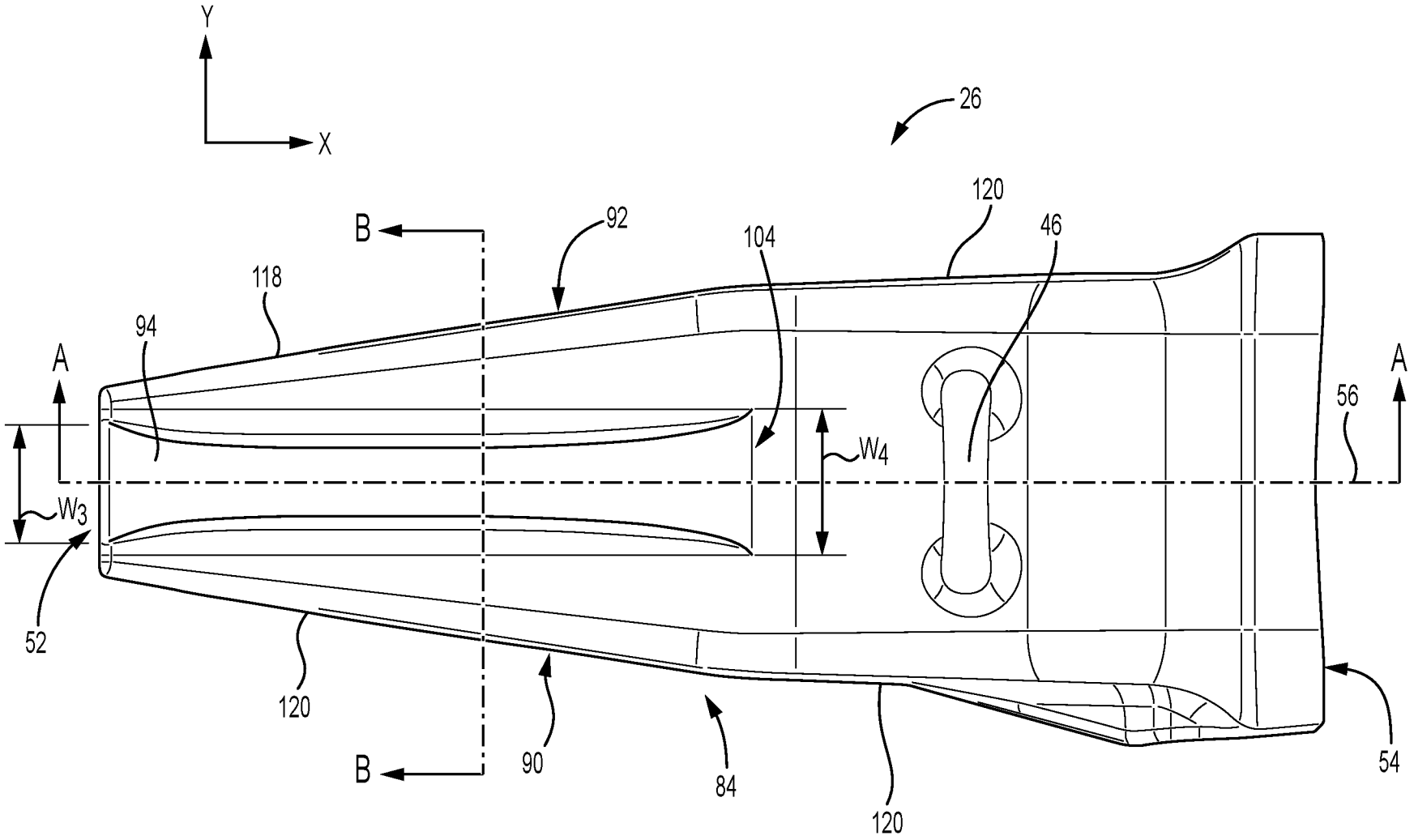
FIG. 6 is a top plan view of the wear member of FIG. 3.

FIG. 6 is a top plan view of wear member 26. As illustrated in FIG. 6, side outer surfaces 90 and 92 are disposed generally symmetrically about longitudinal axis 56. In some exemplary embodiments, however, side outer surfaces 90 and 92 may be disposed asymmetrically about longitudinal axis 56. Each of side outer surfaces 90 and 92 may include front side surface 118 and rear side surface 120. As illustrated in FIG. 5, front side surfaces 118 of side outer surfaces 108 and 110 may extend from front surface 52 towards rear surface 54 of wear member 26 and up to tip end 84. Rear side surfaces 120 of side outer surfaces 90 and 92 may extend from tip end 84 and front side surface 118 to rear surface 54. In one exemplary embodiment as illustrated in FIG. 5, portions of rear side surfaces 120 are disposed generally parallel to each other and to longitudinal axis 56. However, in some exemplary embodiments, rear side surfaces 120 may be disposed generally inclined relative to each other and relative to longitudinal axis 56. Front side surfaces 118 may converge towards the front surface 52 as front side surface 118 extend from rear side surfaces 120 towards front surface 52. In one exemplary embodiment as illustrated in FIG. 5, tip end 84 defines an axial location where rear side surfaces 120 transition to front side surfaces 118. Further, as illustrated in the exemplary embodiment of FIG. 5, side outer surfaces 108 and 110 converge from tip end 84 towards front surface 52.

As illustrated in FIG. 6, rib 94 may be disposed generally symmetrically about longitudinal axis 56. Further rib 94 may have a width "$W_3$" at front surface 52 and a width "$W_4$" at rib rear end 104. In one exemplary embodiment as illustrated in FIG. 6, a width of rib 94 may increase as rib 94 extends from front surface 52 towards rib rear end 104. Thus, width $W_4$ of rib 94 at rib rear end 104 may be larger than width $W_3$ of rib 94 at front surface 52. In some exemplary embodiments, however, width $W_4$ of rib 94 may be smaller than or equal to width $W_3$ of rib 94. Thus, in some exemplary embodiments, a width of rib 94 may increase or may remain constant as rib 94 extends from front surface 52 to rib rear end 104. Further, in some exemplary embodiments, rib 94 may be disposed asymmetrically about longitudinal axis 56 or may be disposed on either side of longitudinal axis 56.

As also illustrated in FIG. 6, a width of rib 94 may be smaller than a maximum width of body 44. In some exemplary embodiments as illustrated in FIG. 6, a maximum width of rib 94 (or rib width) may be smaller than a width of front surface 52 (or front surface width). In some exemplary embodiments, a width ratio of a width of body 44 (or wear member width) to a maximum width of rib 94 (or rib width) may range between about 2.5 to 20.0. Although only one rib 94 has been illustrated in FIGS. 1, 3, 5, and 6, and described above, it should be understood that more than one rib 94 of similar or varying lengths and widths may be disposed on top outer surface 86.

Returning to FIG. 4, body 44 of wear member 26 may include nose cavity 130 that may extend from rear surface 54 towards front surface 52 (e.g., in the −X direction) along longitudinal axis 56. Nose cavity 130 may include a front wall (not shown) disposed between front surface 52 and rear surface 54. Nose cavity 130 may be configured to slidingly receive nose 34 of adapter 32. In one exemplary embodiment as illustrated in FIG. 4, nose cavity 130 has a generally square cross-section. In other exemplary embodiments, nose cavity 130 may have a cross-section having other shapes, for example, rectangular, circle, triangular, polygonal, or any other desired shape.

Nose cavity 130 may include side walls 132 and 134, top wall 136, and bottom wall 138. As illustrated in FIG. 4 side wall 132 may include inner surface 140 that may be spaced apart from side outer surface 90 by a thickness of side wall 132. Similarly, side wall 134 may include inner surface 142 that may be spaced apart from side outer surface 92 by a thickness of side wall 134. Top wall 136 and bottom wall 138 may similarly include inner surfaces that may be spaced apart from top outer surface 86 and bottom outer surface 88, respectively.

As further illustrated in FIG. 4, side wall 132 may include thru hole 144 and side wall 134 may include thru hole 146. Thru hole 144 may extend from side outer surface 90 to inner surface 140 and may be in communication with nose cavity 130. Thru hole 144 may be configured to receive portions of a retention mechanism (not shown) that may be configured to attach wear member 26 to adapter 32 (see FIG. 2). Thru hole 146 may extend from side outer surface 92 to inner surface 142 and may be in communication with nose cavity 130. In one exemplary embodiment as illustrated in FIGS. 3 and 4, thru holes 144 and 146 are disposed generally coaxially with each other. As also illustrated in FIG. 4, side wall 132 may include channel 148 disposed on inner surface 140. Channel 148 may extend from rear surface 54 towards front surface 52 and may intersect with thru hole 144. Channel 148 may be configured to slidingly receive lug 42 (see FIG. 2) of adapter 32 (see FIG. 2) when wear member 26 is assembled on to adapter 32. Although channel 148 has been illustrated and described as being disposed only on inner surface 140, wear member 26 may include channel 148 on inner surface 142 where channel 148 may extend from rear surface 54 towards front surface 52 and may intersect with thru hole 146.

Returning to FIG. 3, wear member 26 may include earpad 150 protruding laterally outward (e.g., in the −Y direction) from side outer surface 90. Earpad 150 may allow for accommodation of channel 148 on inner surface 140 of side wall 132 of nose cavity 130. Although earpad 150 has been illustrated in FIG. 3 as being disposed only on side outer surface 90, wear member 26 may include earpad 150 on one or both of side outer surfaces 90 and 92, for example, to accommodate channels 148 on respective inner surfaces 140 and 142.

Figure 7:
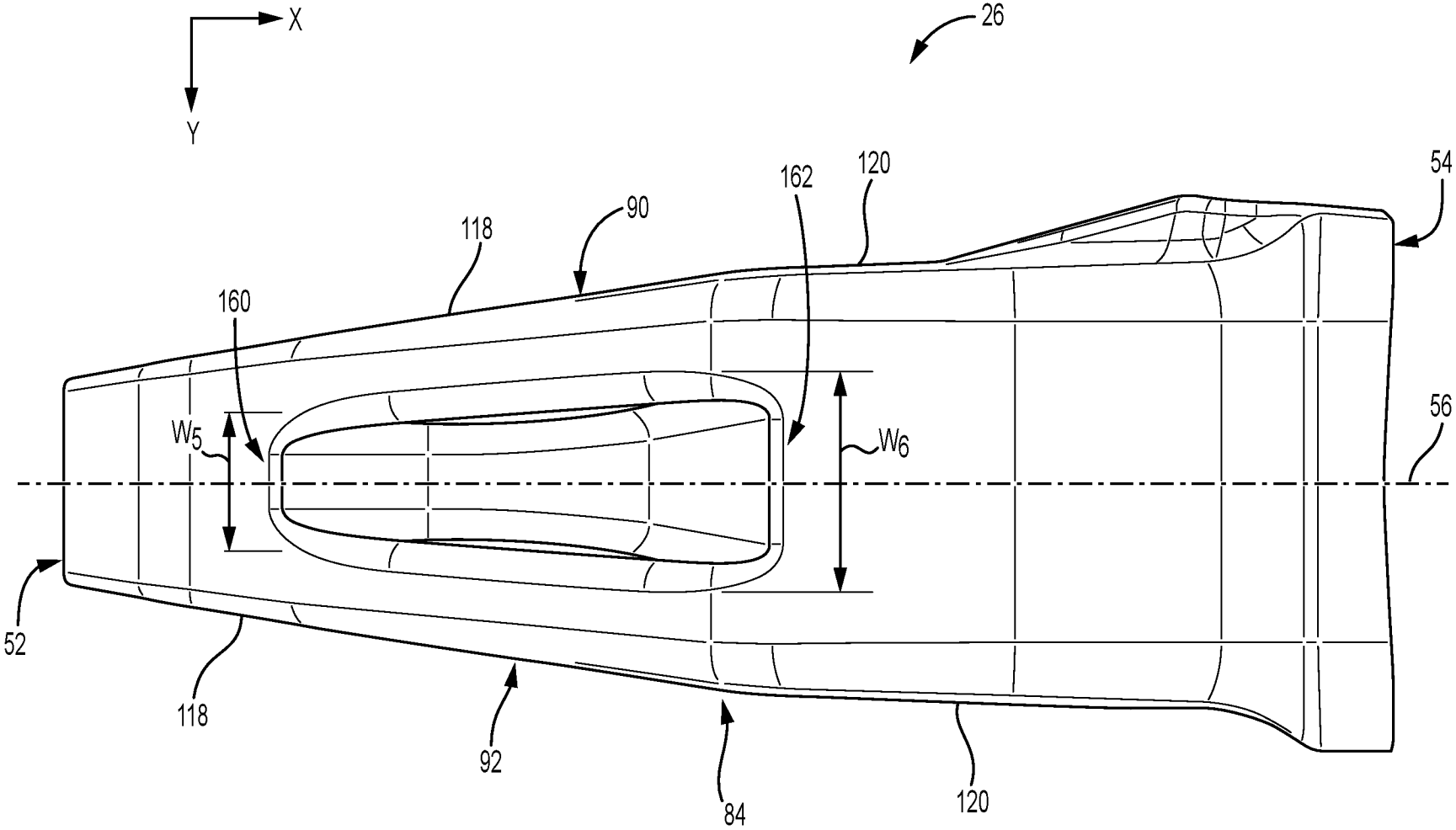
FIG. 7 is a bottom plan view of the wear member of FIG. 3.

As discussed above, wear member 26 may include scoop 96 disposed on bottom outer surface 88. FIG. 7 is illustrates a bottom plan view of wear member 26 showing a bottom plan view of scoop 96. As illustrated in FIG. 7, scoop 96 may extend between scoop front end 160 and scoop rear end 162. Scoop front end 160 may be disposed between front surface 52 and tip end 84, whereas scoop rear end 162 may be disposed between tip end 84 and rear surface 54. In some exemplary embodiments, scoop 96 may be disposed on intermediate bottom surface 116 such that both scoop front end 160 and scoop rear end 162 may be located between front surface 52 and tip end 84. In some exemplary embodiments, scoop rear end 162 may be disposed nearer to rear surface 54 as compared to rib rear end 104 (see FIG. 6). In other exemplary embodiments, rib rear end 104 and scoop rear end 162 may be located at a same distance from rear surface 54. Alternatively, rib rear end 104 may be disposed nearer to rear surface 54 as compared to scoop rear end 162.

In one exemplary embodiment as illustrated in FIG. 7, scoop 96 may be disposed generally symmetrically about longitudinal axis 56. Scoop 96 may have a width "$W_5$" at scoop front end 160 and a width "$W_6$" at scoop rear end 162. In one exemplary embodiment as illustrated in FIG. 7, a width of scoop 96 decreases as scoop 96 extends between scoop rear end 162 and scoop front end 160. For example, width $W_6$ at scoop rear end 162 is larger than width $W_5$ at scoop front end 160. However, in some exemplary embodiments the width of scoop 96 may increase or may remain constant as scoop 96 extends between scoop rear end 162 and scoop front end 160.

In some exemplary embodiments, a ratio of a length of wear member 26 (e.g., length along longitudinal axis 56 from front surface 52 to rear surface 54) and a length of scoop 96 (e.g., scoop length along longitudinal axis 56 from scoop front end 160 to scoop rear end 162) may range between 2.0 and 2.5. In some exemplary embodiments, a ratio of the scoop length of scoop 96 to a distance of scoop rear end 162 from rear surface 54 along longitudinal axis 56 may range between 1.5 and 2.5. In some exemplary embodiments, a ratio of a maxim width of body 44 at rear surface 54 to a maximum width of scoop 96 may range between 2 and 3. Further, in some exemplary embodiments, scoop 96 may be disposed asymmetrically about longitudinal axis 56 or may be disposed on either side of longitudinal axis 56. Additionally, although only one scoop 96 has been illustrated in FIGS. 4 and 7 and described above, it should be understood that wear member 26 may include any number of scoops 96 arranged along longitudinal axis 56 and/or along a transverse axis perpendicular to longitudinal axis 56.

Figure 8:
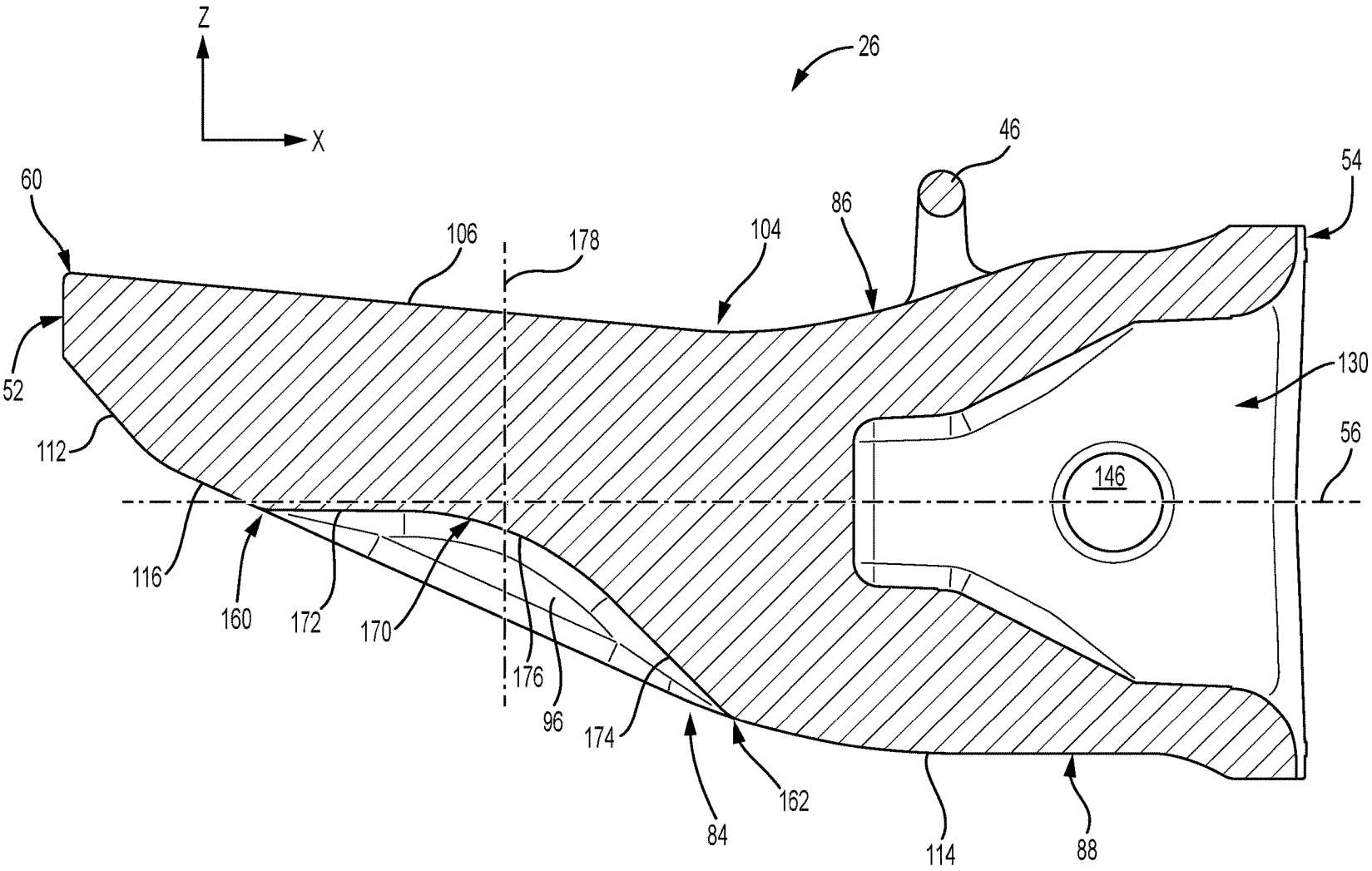
FIG. 8 is a view of a vertical cross-section of the wear member of FIG. 3 taken along line A-A in FIG. 5.

FIG. 8 illustrates an exemplary vertical cross-sectional view (e.g., in the X-Z mid-plane) of wear member 26 taken along line A-A of FIG. 6. In one exemplary embodiment as illustrated in FIG. 8, front surface 52 is disposed generally perpendicular to longitudinal axis 56 and generally parallel to rear surface 54. In some exemplary embodiments, front surface 52 may be inclined relative to longitudinal axis and rear surface 54. Further, Rear surface 54 may be disposed symmetrically about longitudinal axis 56 and/or about a horizontal mid-plane disposed generally perpendicular to front surface 52 and rear surface 54 and passing through longitudinal axis 56.

As also illustrated in FIG. 8, scoop 96 may include scoop base 170 disposed between bottom outer surface 88 and horizontal mid-plane 58. Scoop base 170 may include front scoop surface 172, rear scoop surface 174, and intermediate scoop surface 176. Front scoop surface 172 of scoop 96 may extend from scoop front end 160 towards scoop rear end 162. In one exemplary embodiment as illustrated in FIG. 8, front scoop surface 172 is upwardly inclined (e.g., in the +Z direction) towards longitudinal axis 56 as front scoop surface 172 extends from scoop front end 160 towards scoop rear end 162. In another exemplary embodiment, front scoop surface 172 may be downwardly inclined (e.g., in the −Z direction) towards longitudinal axis 56 as front scoop surface 172 extends from scoop front end 160 towards scoop rear end 162, or may be disposed generally parallel to longitudinal axis 56. Rear scoop surface 174 of scoop 96 may extend from scoop rear end 162 towards scoop front end 160. In one exemplary embodiment as illustrated in FIG. 8, rear scoop surface 174 is upwardly inclined (e.g., in the +Z direction) towards longitudinal axis 56 as rear scoop surface 174 extends from scoop rear end 162 towards scoop front end 160. Intermediate scoop surface 176 may extend from front scoop surface 172 to rear scoop surface 174 of scoop 96. Intermediate scoop surface 176 may connect front scoop surface 172 and rear scoop surface 174. In one exemplary embodiment as illustrated in FIG. 8, intermediate scoop surface 176 has a generally curvilinear shape. Intermediate scoop surface 176, however, may have any other desired shape. A depth of scoop 96 may be defined as a generally vertical distance (e.g., along the Z axis) between bottom outer surface 88 and scoop base 170. As illustrated in FIG. 8, vertical axis 178 passes through a midpoint disposed on bottom outer surface 88 between scoop front end 160 and scoop rear end 162. In one exemplary embodiment as illustrated in FIG. 8, a maximum depth of scoop 96 occurs at a location that may be rearward from vertical axis 178. That is, the maximum depth of scoop 96 occurs at a location between vertical axis 178 and scoop rear end 162. In other exemplary embodiments, however, the maximum depth of scoop 96 may be located at an intersection of scoop base 170 with vertical axis 178. Alternatively, in some exemplary embodiments, the maximum depth of scoop 96 may occur at a location between scoop front end 160 and vertical axis 178.

Figure 9:
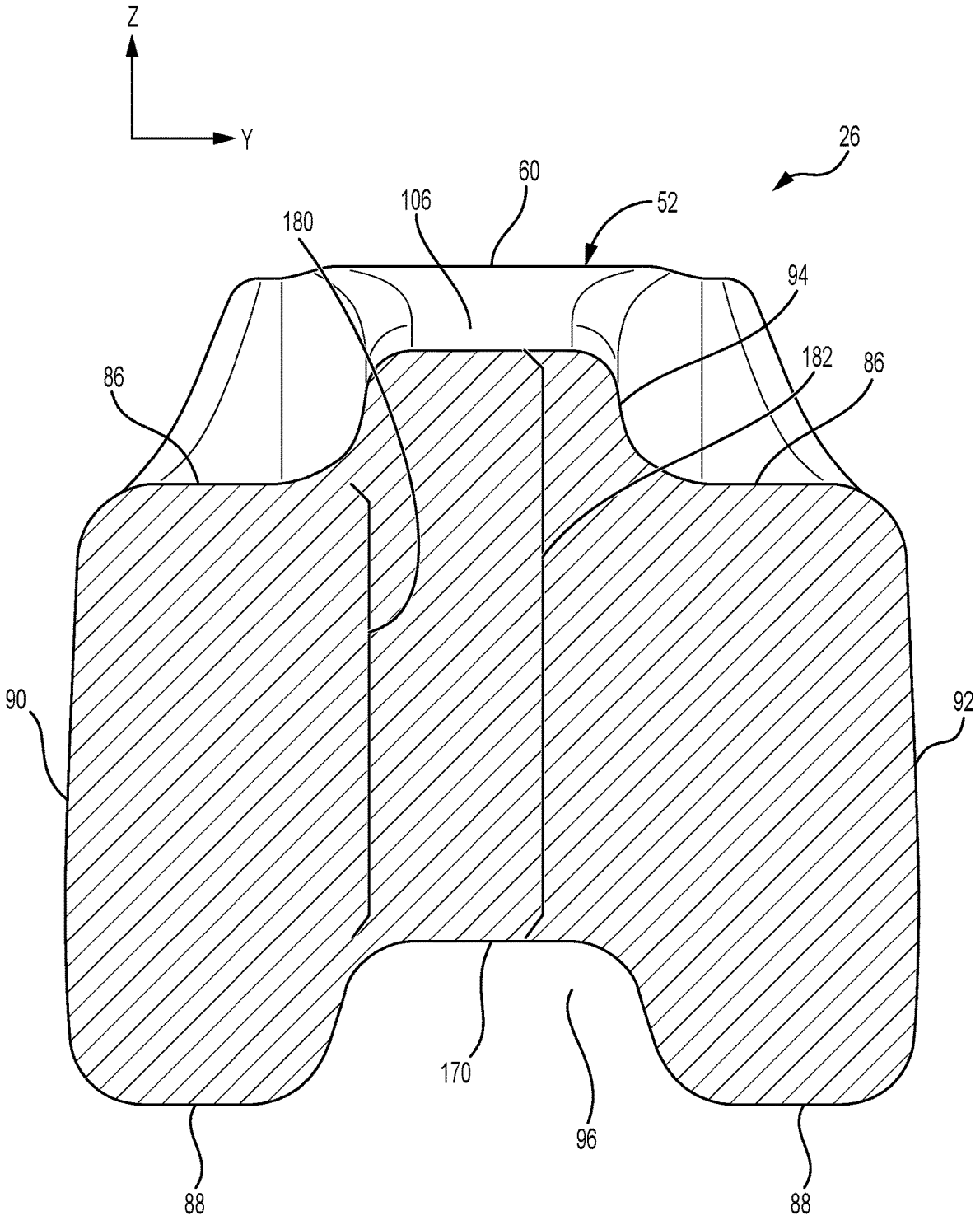
FIG. 9 is a view of a vertical cross-section of the wear member of FIG. 3 taken along line B-B in FIG. 5.

FIG. 9 illustrates an exemplary vertical cross-sectional view (e.g., in the Y-Z mid-plane) of wear member 26 taken along line B-B of FIG. 6. As illustrated in FIG. 9, rib 94 protrudes upwards (e.g., in the +Z direction) from top outer surface 86 of body 44. As also illustrated in FIG. 9, scoop 96 may extend into body 44 from bottom outer surface 88 towards top outer surface 86 such that scoop base 170 may be located between top outer surface 86 and bottom outer surface 88.

The terms generally and about as used in this disclosure should be interpreted to encompass commonly understood design, machining, and manufacturing tolerances. In some exemplary embodiments, such tolerances for a particular dimension or parameter may be ±5% of the magnitude of that particular dimension or parameter. Thus, for example, a ratio of 4 may encompass a range between 3.8 and 4.2. As another example, the phrase generally parallel should be interpreted as encompassing angles in the range of 0°±5°. Similarly, the phrase generally perpendicular should be interpreted as encompassing angles in the range of 90°±5° and the term generally inclined should be interpreted as encompassing angles different from 0°±5° and 90°±5°.

INDUSTRIAL APPLICABILITY

The disclosed wear member may be used with various earth-working machines, such as wheel loaders, cable shovels, drag lines, electric rope shovels, excavators, and front shovels. Specifically, the disclosed wear member may be attached to lip portions of the ground engaging implements of these machines.

As discussed above, wear member 26 may include rib 94 and scoop 96 disposed on top outer surface 86 and bottom outer surface 88, respectively. The presence of scoop 96 may help provide a knife-like shape to wear member 26 that may help to improve the ability of wear member 26 to penetrate and/or cut into the working material. As also discussed above, wear member 26 may include rib 94 protruding from top outer surface 86. Rib 94 may provide additional stiffness to wear member 26 to help prevent breakage of wear member 26 due to the decreased cross sectional area of region 180 (see FIG. 9) created by the presence of scoop 96. For example, as illustrated in FIG. 9, the presence of rib 94 may provide a larger cross-sectional area in region 182 of wear member 26. The increased cross-sectional area may help reduce an amount of stress in wear member 26 when wear member 26 is used to penetrate and or cut into work material. Furthermore, a useable life of wear member 26 may be increased because the additional material provided to fabricate rib 94 would have to be abraded sufficiently before it is necessary to replace wear member 26. Thus, wear member 26 of the present disclosure may provide improved wear resistance while preserving the ability of the tip to easily penetrate the working material.

It will be apparent to those skilled in the art that various modifications and variations can be made to the disclosed wear member and tip assembly. Other embodiments will be apparent to those skilled in the art from consideration of the specification and practice of the disclosed wear member and tip assembly. It is intended that the specification and examples be considered as exemplary only, with a true scope being indicated by the following claims and their equivalents.

What is claimed is:

1. A wear member, comprising:

a body extending from a front surface to a rear surface disposed generally perpendicular to a longitudinal axis, the body defining a mid-plane for the rear surface, the mid-plane being perpendicular to the rear surface and including the longitudinal axis;

a top outer surface, wherein the front surface of the body and the top outer surface are disposed on one side of the mid-plane;

a bottom outer surface, the top outer surface and the bottom outer surface extending from the rear surface and converging at the front surface;

first and second side outer surfaces disposed about the longitudinal axis, and extending from the rear surface to the front surface and between the top outer surface and the bottom outer surface;

a rib protruding from the top outer surface and including a rib outer surface disposed at a first distance from the mid-plane at the front surface and at a second distance from the mid-plane at a location between the front surface and the rear surface, the second distance being smaller than or about equal to the first distance; and a scoop extending into the body from the bottom outer surface towards the top outer surface.

2. The wear member of claim 1, wherein the front surface is generally parallel to the rear surface.

3. The wear member of claim 1, wherein the front surface is narrower than the rear surface.

4. The wear member of claim 1, wherein, the rear surface extends from a rear surface lower edge to a rear surface upper edge; and the front surface extends from a front surface lower edge to a front surface upper edge.

5. The wear member of claim 4, wherein a first height of the front surface upper edge relative to the mid-plane is less than or about equal to a second height of the rear surface upper edge relative to the mid-plane.

6. The wear member of claim 4, wherein a first height of the front surface upper edge relative to the mid-plane is greater than a second height of the rear surface upper edge relative to the mid-plane.

7. The wear member of claim 1, wherein the bottom outer surface includes:

a rear bottom surface extending from the rear surface towards the front surface;

a front bottom surface extending from the front surface toward the rear surface; and an intermediate bottom surface extending from the rear bottom surface to the front bottom surface.

8. The wear member of claim 7, wherein the front bottom surface is inclined at a first angle relative to the mid-plane, and the intermediate bottom surface is angled at a second angle relative to the mid-plane, the second angle being different from the first angle.

9. The wear member of claim 8, wherein the second angle is smaller than the first angle.

10. The wear member of claim 7, wherein the scoop is disposed on the intermediate bottom surface.

11. The wear member of claim 1, wherein a ratio of a length of the wear member to a scoop length ranges between about 2.0 to 2.5.

12. A wear member, comprising:

a body extending from a front surface to a rear surface disposed generally perpendicular to a longitudinal axis, the body defining a mid-plane for the rear surface, the mid-plane being perpendicular to the rear surface and including the longitudinal axis, wherein the front surface is disposed above the mid-plane;

a top outer surface;

a bottom outer surface, the top outer surface and the bottom outer surface extending from the rear surface and converging at the front surface, the bottom outer surface including:

a rear bottom surface extending from the rear surface towards the front surface;

a front bottom surface extending from the front surface toward the rear surface, the front bottom surface inclined at a first angle relative to the mid-plane; and an intermediate bottom surface extending from the rear bottom surface to the front bottom surface, the intermediate bottom surface inclined at a second angle smaller than the first angle relative to the mid-plane;

first and second side outer surfaces converging from the rear surface towards the front surface;

a rib protruding from the top outer surface; and a scoop extending into the body from the bottom outer surface towards the top outer surface.

13. The wear member of claim 12, wherein the rib includes an upper surface inclined relative to the mid-plane.

14. The wear member of claim 12, wherein a ratio of a rib length to a rib width ranges between about 4 to 20.

15. The wear member of claim 12, wherein a rib width is smaller than a front surface width.

16. The wear member of claim 12, wherein the scoop extends between a scoop front end and a scoop rear end, the rib extends from a rib front end to a rib rear end, and the scoop rear end is disposed nearer to the rear surface as compared to the rib rear end.

17. A tip assembly, comprising:

an adapter including a nose and top and bottom legs protruding from the nose, the top and bottom legs defining a gap configured to receive a lip portion of a ground engaging implement; and a wear member configured to be attached to the adapter, the wear member including:

a body extending in a lengthwise direction of the tip assembly from a front surface to a rear surface disposed generally perpendicular to a longitudinal axis, the body defining a mid-plane for the rear surface, the mid-plane being perpendicular to the rear surface and including the longitudinal axis, wherein the front surface is disposed above the mid-plane;

a nose cavity extending into body from the rear surface towards the front surface, the nose cavity configured to receive the nose of the adapter;

a top outer surface;

a bottom outer surface, the top outer surface and the bottom outer surface extending from the rear surface and converging at the front surface, the bottom outer surface including:

a rear bottom surface extending from the rear surface towards the front surface;

a front bottom surface extending from the front surface toward the rear surface, the front bottom surface inclined at a first angle relative to the mid-plane; and an intermediate bottom surface extending from the rear bottom surface to the front bottom surface, the intermediate bottom surface inclined at a second angle smaller than the first angle relative to the mid-plane;

first and second side outer surfaces disposed about the longitudinal axis, the first and second side outer surfaces converging from the rear surface towards the front surface;

a rib protruding from the top outer surface; and a scoop extending into the body from the intermediate bottom surface towards the top outer surface.

18. The tip assembly of claim 17, wherein a first height of an upper edge of the front surface relative to the mid-plane is less than a second height of an upper edge of the rear surface relative to the mid-plane.

19. The tip assembly of claim 17, wherein a width of the scoop decreases in a direction from the rear surface towards the front surface.

20. The tip assembly of claim 17, further including an aperture in each of the first and second side outer surfaces.

* * * * *